US005587546A

United States Patent [19]

Kato et al.

[11] Patent Number: 5,587,546

[45] Date of Patent: Dec. 24, 1996

[54] KARAOKE APPARATUS HAVING EXTENDIBLE AND FIXED LIBRARIES OF SONG DATA FILES

[75] Inventors: Hirokazu Kato, Hamamatsu; Hiroshi Mino, Tokyo, both of Japan

[73] Assignee: Yamaha Corporation, Hamamatsu, Japan

[21] Appl. No.: 339,824

[22] Filed: Nov. 15, 1994

[30] Foreign Application Priority Data

Nov. 16, 1993 [JP] Japan ..... 5-309768

[51] Int. Cl.[6] ..... G10H 1/26; G10H 7/00

[52] U.S. Cl. ..... 84/609; 434/307 A

[58] Field of Search ..... 84/602, 609–614, 84/634–638, 477 R, 478; 358/335, 341, 342; 369/34, 36, 92, 178, 192; 434/307 A

[56] References Cited

U.S. PATENT DOCUMENTS 5,034,935 7/1991 Ishibashi et al. ..... 369/36

5,341,253 8/1994 Liao et al. ..... 358/341 X

*Primary Examiner*—Stanley J. Witkowski

*Attorney, Agent, or Firm*—Loeb & Loeb LLP

[57] ABSTRACT

In a karaoke apparatus for playing a karaoke song designated by a request, a first storage rewriteably stores a plurality of song data files corresponding to a plurality of karaoke songs to form an extendible library which can be updated. Further, a second storage permanently stores another plurality of song data files corresponding to another plurality of karaoke songs to form a fixed library which cannot be update. A directory table recodes a classification of each song data file classified to one of the extendible library and the fixed library. A storage selector responds to a request for addressing the director table to check a classification of a requested song data file, and for retrieving the same selectively from one of the extendible library and the fixed library according to the classification. A tone generator processes the retrieved song data file to sound a desired karaoke song designated by the request.

4 Claims, 2 Drawing Sheets

KARAOKE APPARATUS HAVING EXTENDIBLE AND FIXED LIBRARIES OF SONG DATA FILES

BACKGROUND OF THE INVENTION

The present invention relates to a karaoke apparatus having a tone generator for generating musical tones of a karaoke song based on a song data file. More specifically, the invention relates to the karaoke apparatus of a type having a plurality of storages of different purposes for storing song data files so as to functionally expand a system of the karaoke apparatus.

Various types are developed in the karaoke apparatus which sounds a karaoke song through a loudspeaker while displaying background pictures and lyric words on a monitor. For example, a musical tone reproduction type of the karaoke apparatus has a permanent storage medium such as an optic momory disk which permanently stores a performance data and a background picture data of all entry songs. The permanent storage medium is accessed in response to a request for reading out a data of a requested entry song to present a desired karaoke a performance.

On the other hand, recently a musical tone synthesis type of the karaoke apparatus is developed, which has a rewriteable or reloadable storage medium such as a hard disk (HD). This type of the karaoke apparatus can receive song data files from a host station through a telecommunication line, and can download the song data files into the reloadable storage medium. The karaoke apparatus of the musical tone synthesis type is provide therein with a tone generator which can generate or synthesize musical tones based on the song data file. In view of this, such a type of the karaoke apparatus is called "tone generating karaoke apparatus".

The tone generating karaoke apparatus is advantageous in that the stored song data files can be updated easily. Normally, an individual karaoke apparatus has a definite capacity of a storage medium so that a number of stored song data a files is limited. Therefore, a library of the stored song data files may not contain old karaoke songs which are rarely requested and new karaoke songs which are just released to public use. In such a case., the musical tone reproduction type of the karaoke apparatus must be supplied with a new permanent storage medium which records lacking song data files in order to present nonentry karaoke songs. However, a delivery of the new medium requires a certain time so that the karaoke apparatus cannot readily respond to the request of the nonentry song.

In contrast, the musical tone synthesis type of the karaoke apparatus can readily receive a song data file of a nonentry song from a host station through a telecommunication line. Therefore, the karaoke apparatus can always respond to a request by a karaoke player even though the karaoke apparatus does not store song data file of the requested song in the storage. However, the tone generating karaoke apparatus has the erasable storage of the song data files, composed of the reloadable memory medium. Therefore,, the stored song data files may be inadvertently, updated, or even worse, may be destructed inadvertently.

SUMMARY OF THE INVENTION

An object of the invention is to provide an improved karaoke apparatus having rewriteable and permanent storages of the song data files to eliminate drawbacks of either of the musical tone synthesis system and the musical tone reproduction system.

According to the invention, a karaoke apparatus comprises performance means having a tone generator for generating musical tones of a designated karaoke song based on a song data file, first storage means for storing a plurality of song data files corresponding to a plurality of karaoke songs which can be updated, second storage means for storing another plurality of song data files corresponding to another plurality of karaoke songs which cannot be updated, admitting means for admitting a request effective to designate a karaoke song to be performed, table means for indicating which of the first storage means and the second storage means stores a song data file corresponding to the designated karaoke song, and storage selector means for selecting said song data file from one of the first storage means and the second storage means indicated by the table means and for feeding said song data file to the performance means.

In a somewhat different form, the inventive karaoke apparatus for playing a karaoke song designated by a request comprises first storage means for rewriteably storing a plurality of song data flies corresponding to a plurality of karaoke songs to form an extendible library which can be updated, second storage means for permanently storing another plurality of song data flies corresponding to another plurality of karaoke songs to form a fixed library which cannot be updated, directory means having a directory table which records a classification of each song data file classified to one of the extendible library and the fixed library, retrieval means responsive to a request for addressing the directory table to check a classification of a requested song data file, and for retrieving the same selectively from one of the extendible library and the fixed library according to the classification, and tone generator means for processing the retrieved song data file to sound a desired karaoke song designated by the request.

The plurality of the song data files stored in the first storage means can be updated through a communication line or else. The other plurality of the: song data files stored in the second storage means cannot be updated and will be never destructed. Upon a request from a karaoke player, the admitting means controls the selector means to retrieve the requested song data file from one of the first and second storage means with reference to the table means which specifies the storage means storing the requested song data file. The performance means starts a karaoke performance based on the retrieved song data file without regard to an origin or source thereof. By such a manner, the pair of the rewriteable and permanent storages of the song data files are installed to functionally expand a library system of the Karaoke apparatus.

DETAILED DESCRIPTION OF THE INVENTION

Figure 1:
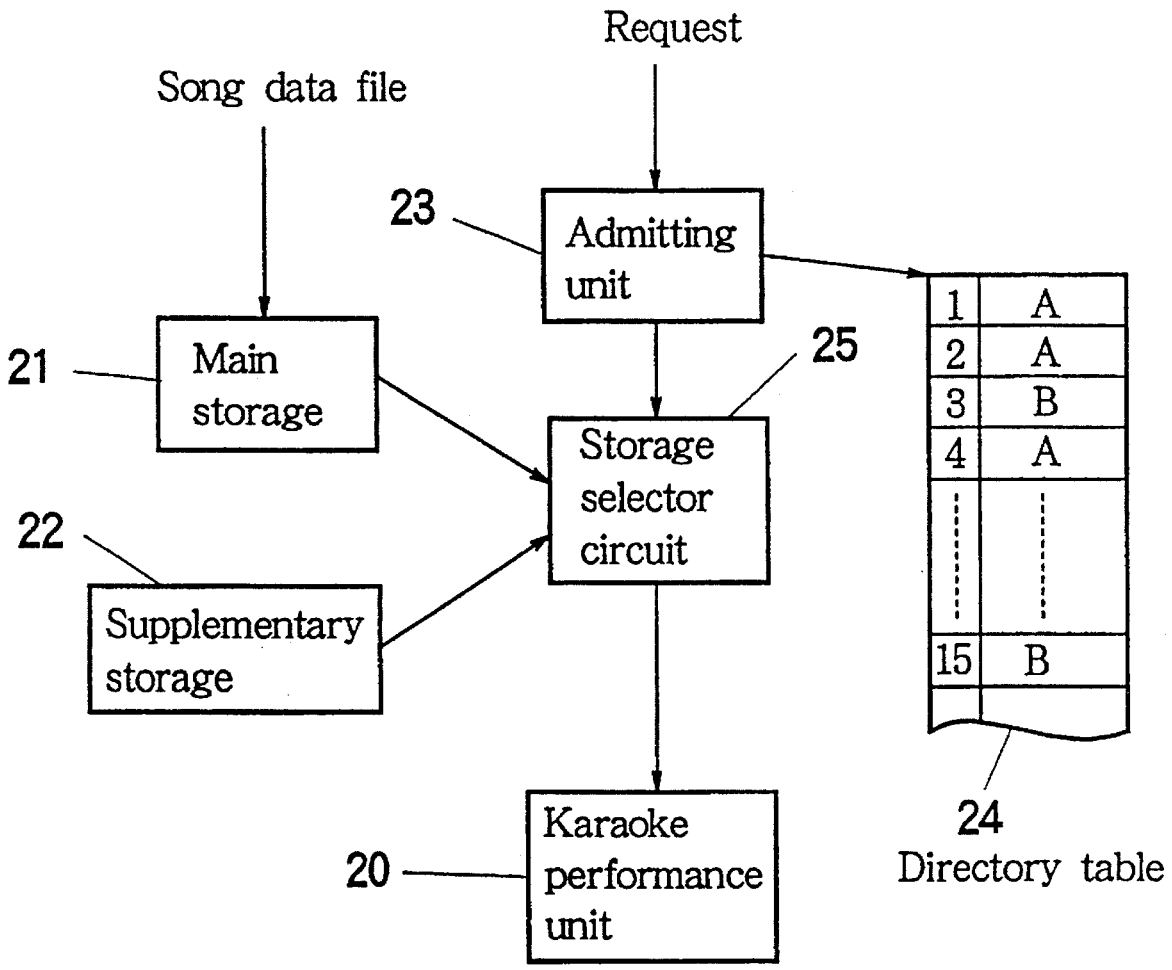
FIG. 1 is a block diagram showing an essential part of the inventive karaoke apparatus.

Hereinafter, embodiments of the invention will be described in conjunction with the drawings. FIG. 1 shows an essential part of the inventive karaoke apparatus. In the figure, the apparatus includes a karaoke performance unit 20 having a tone generator for generating musical tones of a desired karaoke song based on a corresponding song data file, first storage means in the form of a main storage 21 for storing a plurality of song data files which can be updated, second storage means in the form of a supplementary storage 22 for storing another plurality of song data files which cannot be updated, an admitting unit 23 for admitting a request from a karaoke player to designate a desired karaoke song to be performed, a directory table 24 which records which of the main storage 21 and the supplementary storage 22 stores a requested song data file corresponding to the designated karaoke song, and a storage selector circuit 25 for selectively retrieving the requested song data file from one of the main and supplementary storages 21, 22 specified by the directory table 24 and for feeding the retrieved song data file to the karaoke performance unit 20.

The main storage 21 is composed of a rewriteable memory medium such as a hard disk (HDD) and a magneto-optical disk (MO). On the other hand, the supplementary storage 22 is composed of a permanent memory medium such as a read only memory (ROM) and a compact disk (CD). The main storage 21 rewritably or reloadably stores song data files to form an extendible library of karaoke entry songs which can be updated periodically or occasionally. On the other hand, the supplementary storage 22 permanently stores song data files to form a fixed library of karaoke entry songs which cannot be updated. For example, the main storage 21 is utilized to store song data files of free karaoke songs which can be commercially served through a communication line or else without checking copyright thereof. On the other hand, the supplementary storage 22 stores song data files of compulsory songs which cannot be served freely through the communication line due to restriction by copyright or else. Instead, the supplementary storage 22 is supplied as a package to a user of an individual karaoke apparatus.

In operation of the karaoke apparatus, the admitting unit 23 admits from a karaoke player a request which designates a song number of a desired karaoke song to be played. The admitting unit 23 addresses the directory table 24 in response to the request to check which of the main and supplementary storages 21, 22 stores a requested song data of the designated song number. The directory table 24 records a classification A or B for each of the song numbers 1, 2, 3, . . . . The classification A indicates that a corresponding song data file is stored in the main storage 21. The other classification B indicates that a corresponding song data file is stored in the supplementary storage 22. Old records of the directory table 24 are never altered, but new records are accumulated in expanding manner.

The admitting unit 23 passes a pair of a designated song number and a corresponding classification which is read out from the directory table 2.1, to the storage selector circuit 25. Then, the storage selector circuit 25 retrieves a requested song data file of the designated song number from one of the main storage 21 and the supplementary storage 22 specified by the classification passed together with the designated song number. Further, the selector circuit 25 feeds the selected song data file to the karaoke performance unit 20. The performance unit 20 processes the fed song data file to play or perform a desired karaoke song without regard to a source or origin of the song data, file.

Figure 2:
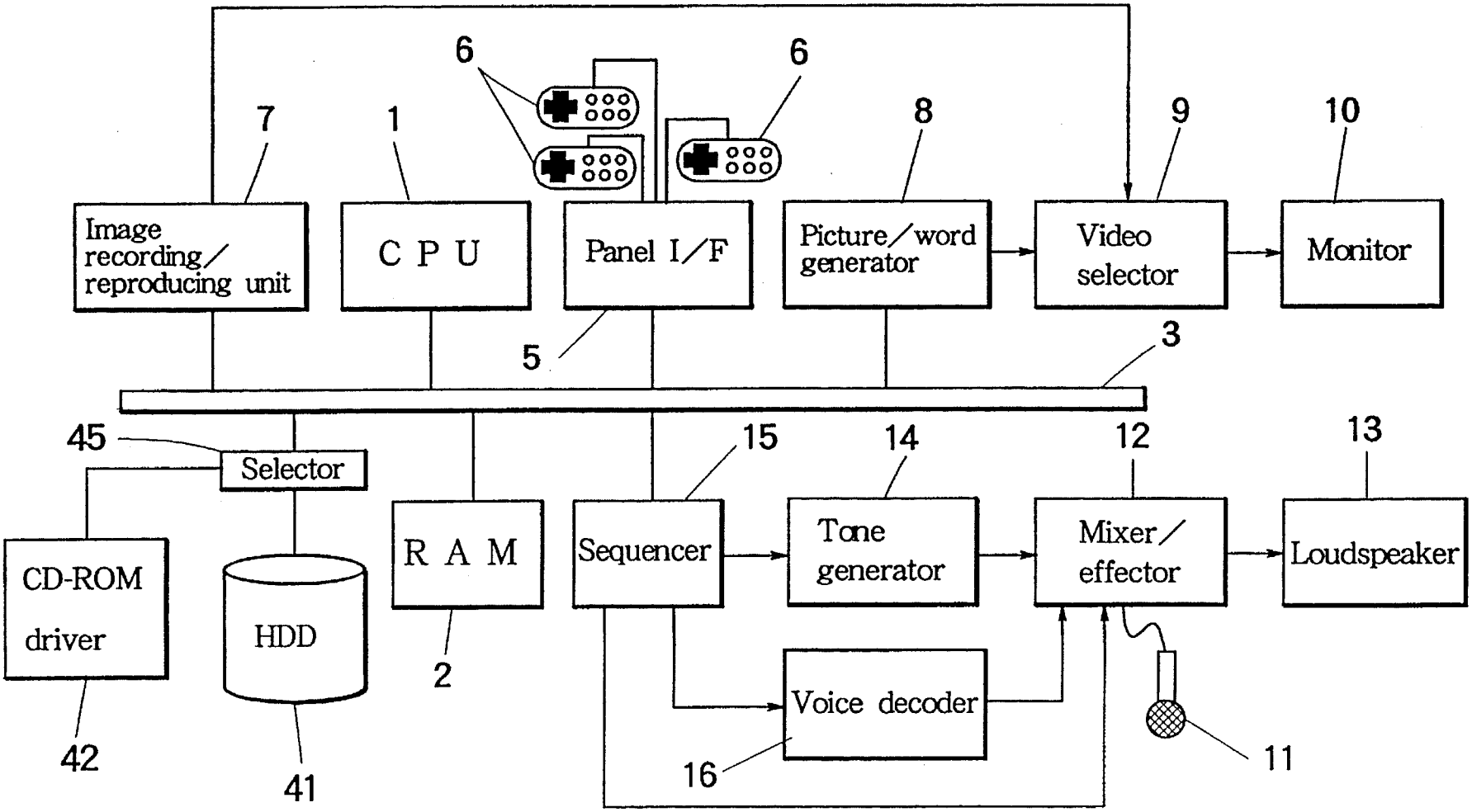
FIG. 2 is a block diagram showing an overall construction of the inventive karaoke apparatus.

FIG. 2 is a block diagram showing an overall construction of the karaoke apparatus containing the karaoke performance unit 20 shown in FIG. 1. The disclosed apparatus includes a central processing unit (CPU) 1 for controlling and managing an entire system of the apparatus, a random access memory (RAM) 2 utilized when the CPU 1 controls and manages the operation of the entire system, and a data address bus line 3 which connects various units to build up the entire system.

The apparatus further includes a hard disk driver (HDD) 41 which corresponds to the main storage 21 of FIG. 1 to store song data files which can be updated, a driver 42 of CD-ROM which corresponds to the supplementary storage 22 of FIG. 1, and a storage selector 45 for selecting one of the HDD 41 and CD-ROM driver 42. In addition, a panel interface (I/F) 5 serves as the admitting unit 23 of FIG. 1 to admit a request which is reserved in the RAM 2. Further, a directory table is recorded in the HDD 41. The directory table is developed in the RAM 2 when a power of the system is turned on. A plurality of commander tools 6 such as a remote controller are connected to the panel I/F 5 to input various commands such as a song request to the system.

Further, the karaoke apparatus includes an image recording/reproducing unit 7 for recording and reproducing a background image, picture/word generator 8 for generating static pictures of a background and characters of lyric words, a video selector 9 for selecting either of the motion background image fed from the image recording/reproducing unit 7 and the static background picture fed from the picture/word generator 8 to compose a composite background image, and a monitor 10 for displaying the composite background image.

The karaoke apparatus further includes a microphone 11 for picking up a singing voice of the player, a mixer/effector 12 for mixing the singing voice and the musical tone of the performed song with each other and for applying various effects to the mixed sounds. A loudspeaker 13 amplifies and outputs the mixed sounds of the singing voice and the generated musical tone of the karaoke song. A tone generator 14 processes a song data, a file to generate musical tones of the karaoke song. A sequencer 15 is provided to control the tone generator 14 and the mixer/effector 12. The sequencer 15 has a program ROM which stores a program used by the CPU 1. Additionally, a digital voice decoder 16 is provided to decode coded digital which data which may be contained in the song data file to sound a back chorus.

In operation of the entire system of the karaoke apparatus, the commander tool 6 is operated to input a request to designate a desired karaoke song, and the CPU 1 addresses the directory table or song list, recorded in the HDD 41 according to the inputted request to retrieve requested to song data file containing coded voice data of a back chorus, if any, from one of the HDD 41 and the CD-ROM driver 42 through the storage selector 45. The retrieved song data a file is transferred to the RAM 2, and the system control is passed from the CPU 1 to the sequencer 15. In this operation, the CPU 1 controls the storage selector 45 to select either of the HDD 41 and the CD-ROM driver 42 in manner as described in conjunction with FIG. 1.

The sequencer 15 executes various events including a performance of the karaoke song in parallel manner according to a plurality of event data contained in the song data file. Namely, the sequencer 15 distributes tone event data concerning tones of instruments to the tone generator 14, distributes a voice event data such as the digital coded voice data to the digital voice decoder 16, distributes a background image event data such as a frame number of each background image to the image recording/reproducing unit 7, and distributes a word event data of lyrics to the picture/word generator 8. Consequently, the loudspeaker 13 sounds the instrumental accompaniment and the back chorus of the designated karaoke song, while the monitor 10 displays the background image superimposed with characters of the lyric words on a screen.

The disclosed embodiment utilizes a pair of the main and supplementary storages. However, more than two of different storages may be installed in the karaoke apparatus. Further, the supplementary storage may store various data such as a background image data in addition to tile song data. By this, the background image data can be read out concurrently with the song data in synchronized manner.

As described above, according to the invention, the karaoke apparatus utilizes a pair of a rewriteable storage medium and a permanent storage medium of song data files to thereby obviate drawbacks of either of an open data storage system and a closed data storage system. In detail, the open data storage and the closed data storage are integrated to the karaoke system to realize benefits of both of the open and closed storages. The song data file can be reserved safely without destruction in the permanent storage medium. A data package management can be realized without destruction by means of the permanent storage medium. An unnecessary song data file can be readily erased from the rewriteable storage.

What is claimed is:

1. A karaoke apparatus comprising:

performance means having a tone generator for generating musical tones of a designated karaoke song based on a song data file;

first storage means for storing a plurality of song data files corresponding to a plurality of karaoke songs, the first storage means being updateable without removal of the first storage means from the karaoke apparatus;

second storage means for storing another plurality of song data files corresponding to another plurality of karaoke songs the second storage means being updateable only by removal of the second storage means from the karaoke apparatus;

admitting means for admitting a request effective to designate a karaoke song to be performed;

table means for indicating which of the first storage means and the second storage means stores a song data file corresponding to the designated karaoke song; and storage selector means for selecting said song data file from one of the first storage means and the second storage means indicated by the table means and for providing said song data file to the performance means.

2. A karaoke apparatus for playing a karaoke song designated by a request, comprising:

first storage means for rewritteably storing a plurality of song data files corresponding to a plurality of karaoke songs to form an extendible library which can be updated;

second storage means for permanently storing another plurality of song data files corresponding to another plurality of karaoke songs to form a fixed library which cannot be updated;

director means having a directory table which records a classification of each song data file to classify each song data file to one of the extendible library and the fixed library;

retrieval means responsive to a request for addressing the directory table to check a classification of a requested song data file, and for retrieving the same selectively from one of the extendible library and the fixed library according to the classification; and tone generator means for processing the retrieved song data file to sound a desired karaoke song designated by the request.

3. A karaoke apparatus comprising:

a performance circuit having a tone generator that generates musical tones of a designated karaoke song based on a song data file;

a first storage medium of a first type that stores a plurality of song data files corresponding to a plurality of karaoke songs which can be updated without removing the first storage medium from the karaoke apparatus;

a second storage medium of a second type that is different from the first type and that stores another plurality of song data files corresponding to another plurality of karaoke songs which cannot be updated without removing the second storage medium from the karaoke apparatus;

an admitting circuit that admits a request that is effective to designate a karaoke song to be performed;

a table circuit that indicates which of the first storage medium and the second storage medium stores a song data file corresponding to the designated karaoke song; and a storage selector circuit that selects the song data file from one of the first storage medium and the second storage medium indicated by the table circuit and that provides the song data file to the performance circuit.

4. A karaoke apparatus for playing a karaoke song designated by a request, comprising:

a first storage medium of a first type that rewritteably stores a plurality of song data files corresponding to a plurality of karaoke songs to form an extendible library which can be updated without removing the first storage medium;

a second storage medium of a second type that permanently stores another plurality of song data files corresponding to another plurality of karaoke songs to form a fixed library which cannot be updated without removing the second storage medium;

a director circuit having a directory table which records a classification of each song data file to classify each song data file to one of the extendible library and the fixed library;

a retrieval circuit responsive to a request to address the directory table to check a classification of a requested song data file, and that retrieves the same selectively from one of the extendible library and the fixed library according to the classification; and a tone generator that processes the retrieved song data file to sound a desired karaoke song designated by the request.

* * * * *